United States Patent [19]

Sugihara et al.

[11] Patent Number: 4,945,329

[45] Date of Patent: Jul. 31, 1990

[54] TRIPPING DEVICE WITH BURNING PREVENTION SWITCH

[75] Inventors: Kazuyoshi Sugihara; Ichiro Arinobu, both of Fukuyama, Japan

[73] Assignee: Mitsubishi Denki Kabushiki Kaisha, Tokyo, Japan

[21] Appl. No.: 260,133

[22] Filed: Oct. 19, 1988

Related U.S. Application Data

[63] Continuation of Ser. No. 10,581, Feb. 3, 1987, abandoned.

[51] Int. Cl.[5] ..... H01F 1/00

[52] U.S. Cl. ..... 335/219; 335/132

[58] Field of Search ..... 335/78-85, 335/1, 2, 141-145, 217-219, 132, 202

[56] References Cited

U.S. PATENT DOCUMENTS

| | | | |
|---|---|---|---|
| 2,540,466 | 2/1951 | Welch | 335/142 |
| 3,949,333 | 4/1976 | Freitag et al. | 335/132 |
| 4,254,392 | 3/1981 | Prohaska et al. | 335/128 |
| 4,345,225 | 8/1982 | Lemmer | 335/132 |

FOREIGN PATENT DOCUMENTS

| | | |
|---|---|---|
| 0133333 | 2/1985 | European Pat. Off. . |
| 227944 | 11/1910 | Fed. Rep. of Germany . |
| 54-3364 | 1/1979 | Japan . |

*Primary Examiner*—Leo P. Picard
*Assistant Examiner*—Lincoln Donovan
*Attorney, Agent, or Firm*—Lowe, Price, LeBlanc, Becker & Shur

[57] ABSTRACT

A tripping device with burning prevention switch has a electromagnet 10 and a burning prevention switch 14 both of which are cased in each separate insulating bodies. The electromagnet 10 and the burning prevention switch 14 are combined by engagement of projections 15, 16, provided on the burning prevention switch 14 and a hollow 12 and a hole 13, respectively, that are provided on the electromagnet 10.

3 Claims, 5 Drawing Sheets

TRIPPING DEVICE WITH BURNING PREVENTION SWITCH

This is a continuation of application Ser. No. 010,581, filed Feb. 3, 1987, now abandoned.

FIELD OF THE INVENTION AND RELATED ART STATEMENT

1. Field of the Invention

The present invention relates to a tripping device with burning prevention switch, and more particularly to a miniaturized switch of this type without deterioration of its insulation characteristic.

2. Description of the Related Art

A typical conventional tripping device with burning prevention switch used in a circuit breaker has a structure and operation as described with reference to FIG. 1, which is a sectional side view of a conventional tripping device with burning prevention switch. The tripping device has an electromagnet 1 and a burning prevention switch 2. The electromagnet 1 consists of a bobbin 1*a*, a coil 1*b*, a plunger 1*c* and a case 1*d* of conductive material. The burning prevention switch 2 consists of a switch 2*a* and a switch lever 2*b*. The burning prevention switch 2 is fixed on an installation bracket 3 which is fixed to the electromagnet 1.

A tripping operation of this device is described below. An impression of a voltage to the coil 1*b* moves the plunger 1*c*, and the moving of the plunger 1*c* trips a trip bar (not shown). When, tripping, a cuss-bar (or a movable contact) not shown pushes the switch lever 2*b* as shown by an arrow 4. The moving of the switch lever 2*b* opens the switch 2*a* and cuts off a current to the coil 1*b*. Burning of the coil 1*b* is prevented, because the current of the coil 1*b* is cut off after the tripping.

Such a conventional tripping device the cannot be installed in small circuit breakers because, the device is large owing to the need for a bracket solely for mounting the burning prevention switch 2.

SUMMARY OF THE INVENTION

It is an object of the present invention to provide a tripping device with burning prevention switch, which is small-sized and has a superior insulating characteristic.

The tripping device with burning prevention switch in accordance with a preferred embodiment of the present invention comprises:

a first insulating enclosure;

electromagnet means for electromagnetically generating a force, having a coil disposed within said first insulating enclosure;

plunger means for generating movement when acted upon by said force, disposed within said electromagnet means and driven by said electromagnet means;

a second insulating enclosure;

burning prevention means for preventing burning of circuit elements in a circuit with said coil, disposed within said second insulating enclosure; and interconnecting means for interconnecting said first insulating enclosure and said second insulating enclosure, said interconnecting means comprising projections integral with and extending outward from one of said first and second enclosures with the other one of said first and second enclosures being formed with corresponding openings for receiving said projections.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWING

FIGS. 2–6 is installed.

DESCRIPTION OF THE PREFERRED EMBODIMENTS

The structure of a preferred embodiment of a tripping device with burning prevention switch embodying the present invention is described in detail with reference to FIGS. 2 to 7.

Figure 7:
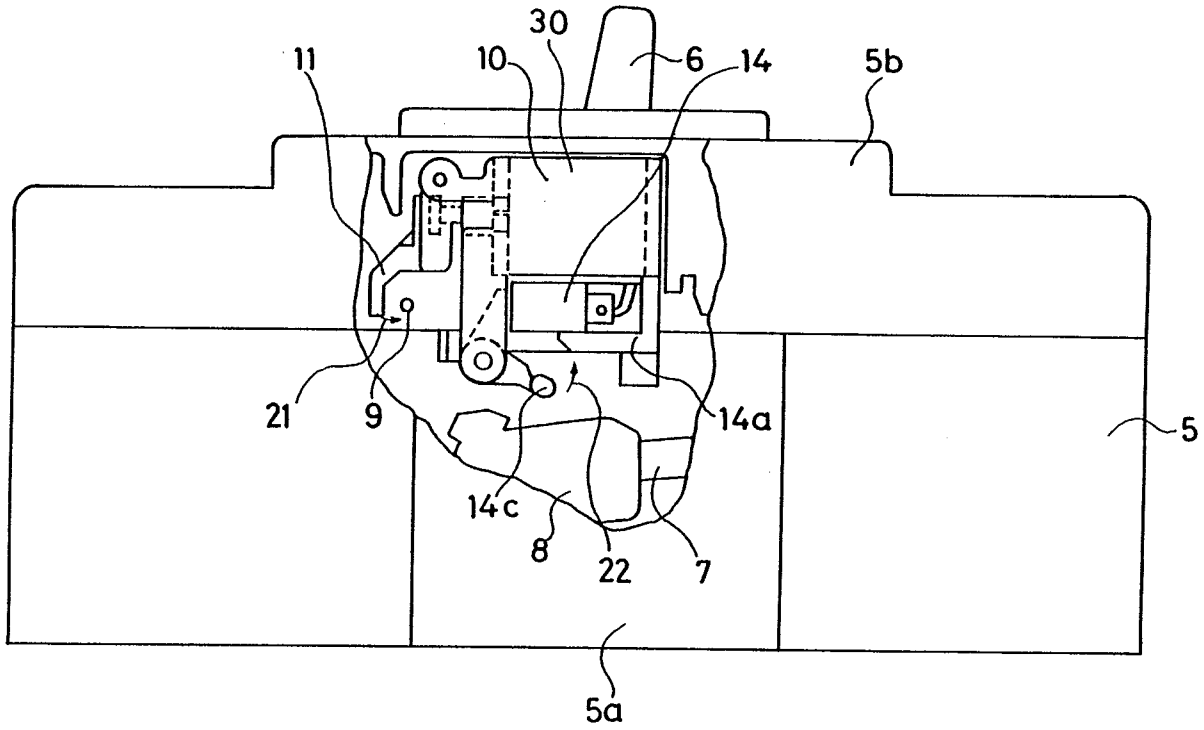
FIG. 7 is a fragmentary cut-away side view of a circuit breaker in which the tripping device with burning prevention switch embodying the present invention per

FIG. 7 shows a manner of installing the tripping device with burning prevention switch in a circuit breaker. As shown in FIG. 7, a case 5 made of an insulating material consists of a base part 5*a* and a cover 5*b*. A handle 6 is projected from the case 5. A movable contact 7, a cross-bar 8 for holding the movable contact 7, a trip bar 9, the tripping device 30 with burning prevention switch are provided in the case 5. The tripping device 30 has an electromagnet 10 and a burning prevention switch 14.

Figure 1:
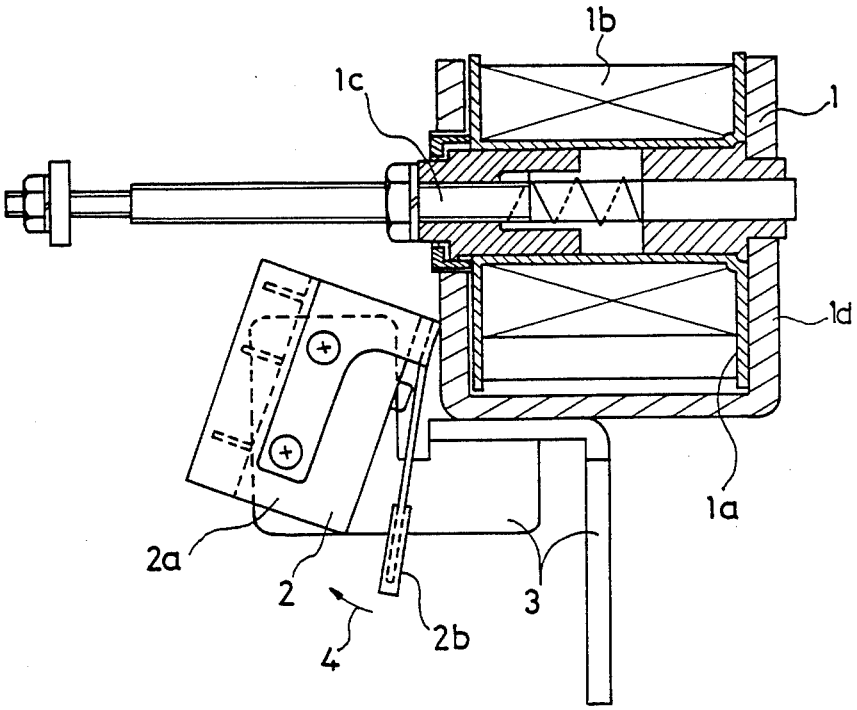
FIG.1 (Prior Art)
FIG. 1 is the cross-sectional side view of a conventional tripping device with a burning prevention switch.
Figure 2:
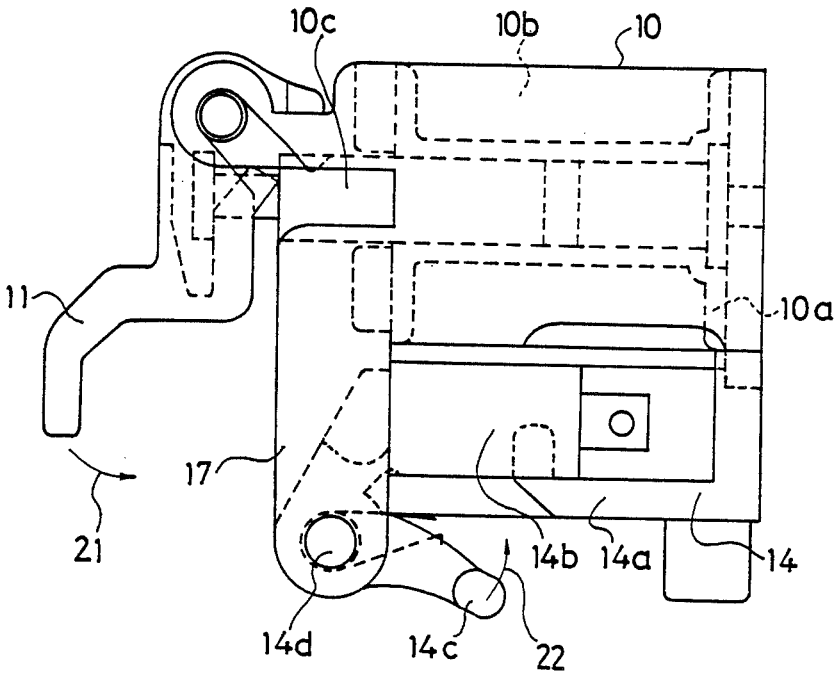
FIG. 2 is a side view of a tripping device with burning prevention switch according to a preferred embodiment of the present invention.
Figure 3:
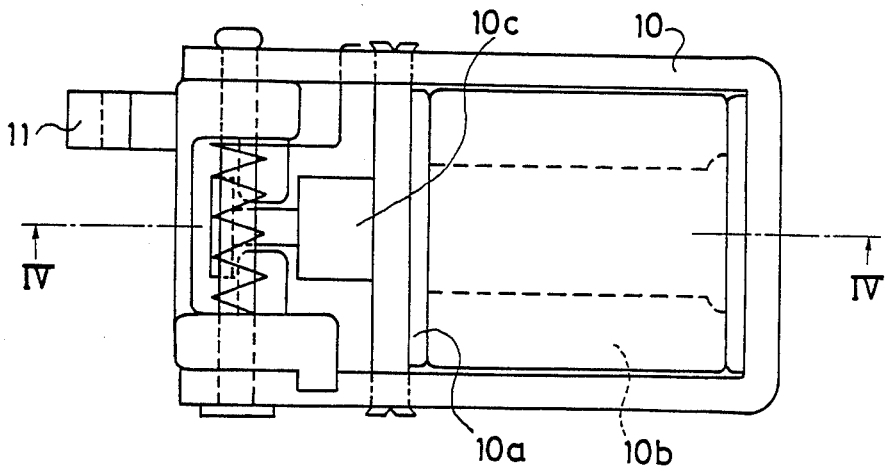
FIG. 3 is a plan view of the tripping device with burning prevention switch of FIG. 3.
Figure 4:
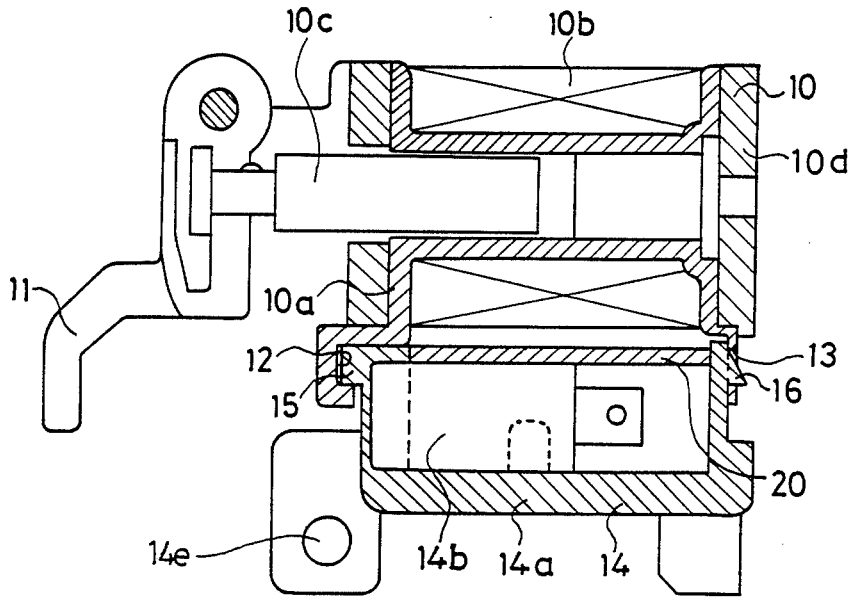
FIG. 4 is a cross-sectional side view of the tripping device with burning prevention switch per FIGS. 2 and 3.

The electromagnet 10 comprises a bobbin 10*a* of insulating material, a coil 10*b*, a plunger 10*c* and a case 10*d*, as shown in FIG. 4. A tripping lever 11 is moved by the plunger 10*c*. The bobbin 10*a* made of insulating material has a hollow 12 as a first hollow which is formed by a bent part of the bobbin 10*a*. Further, the bobbin 10*a* has a hole 13 as a second hollow which is formed on an end of the bobbin 10*a*.

The burning prevention switch 14 comprises an insulating case 14*a*, a switch 14*b* and an insulating paper 20. The insulating case 14*a* has a first projection 15 formed to be engaged to the hollow 12 of the bobbin 10*a* and has a second projection 16 formed to be engaged to the hole 13 of the bobbin 10*a*. The second projection 16 has a beveled slope for easy insertion into the hole 13.

Figure 5:
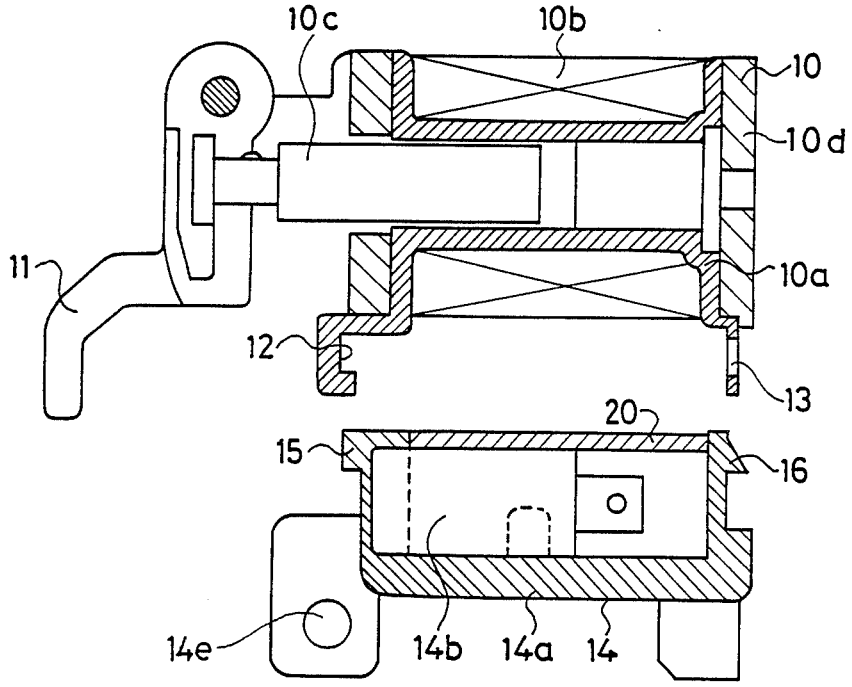
FIG. 5 is a decomposed view of the tripping device with burning prevention switch per FIGS. 2–4.
Figure 6:
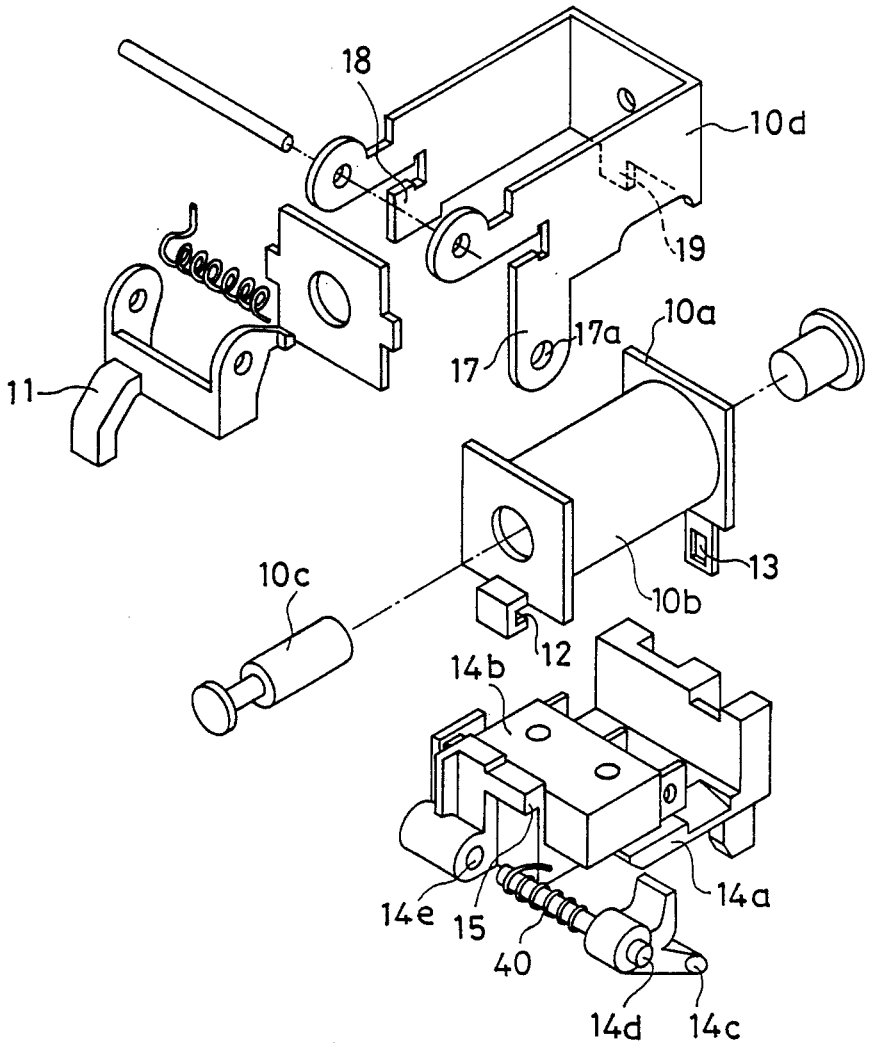
FIG. 6 is an exploded perspective view of the tripping device with burning prevention switch per FIGS. 2–5.

From a state where the electromagnet 10 is separated from the burning prevention switch 14 as shown in FIG. 5, the first projection 15 is inserted into the hollow 12. Next, the second projection 16 is slid and tailed into the hole 13 as shown in FIG. 4. Therefore, the device is easily assembled. Then, by inserting a shaft 14*d* for switch lever 14*c* through a hole 17*a* of an arm 17, a spring 40 and a hole 14*e*, as shown in FIG. 6, the electromagnet 10 and the burning prevention switch 14 are strongly affixed to each other.

When tripping is necessary, a voltage is impressed to the coil 10*b* of the electromagnet 10. The impression of a voltage to the coil 10*b* moves the plunger 10*c* as shown by an arrow 21 in FIG. 7 and the moving of the plunger 10*c* trips a trip-bar 9. When tripping, the cross-bar 8 pushes the switch lever 14*c* as shown by an arrow 22. The moving of the switch lever 14*c* opens the switch 14*b* and cut off a current to the coil 10*b*. Therefore, the burning of the coil 10*b* is prevented, because the current of the coil 10*b* is cut off after tripping.

As a modified embodiment, the projection may be provided on the electromagnet 10 and the hollow provided on the burning prevention switch 14.

As has been described in detail for various embodiments, the tripping device with burning prevention switch in accordance with the present invention can be made relatively small in size and has superior insulating characteristic, because the electromagnet 10 and the burning prevention switch 14 are provided within the insulating case and are combined by simple engagement of the projection and the hollow.

Although the invention has been described in it preferred form with a certain degree of particularity, it is understood that the present disclosure of the preferred form changed in the details of construction and the combination and rearrangement of the various parts may be resorted to without departing from the spirit and the scope of the invention as hereinafter claimed.

What is claimed is:

1. An electromagnet tripping switch assembly with nondestructive burning protection, comprising:

a bobbin;

electromagnet means having a coil wound on said bobbin;

plunger means disposed within said electromagnet means and driven by said electromagnet means;

an insulating case having first and second projecting;

burning prevention means in a circuit with said coil within said insulating case; and means for interconnecting said bobbin and said insulating case, said interconnecting means comprising a channel section portion formed in one portion of said bobbin for receiving said first projection of said insulating case another portion of said bobbin having a through-hole for receiving said second projection of said insulating case.

2. The assembly of claim 1, wherein:

said interconnecting means comprising a channel section portion and a through-hole formed separately in an extensive of said bobbin, to each receive a correspondingly disposed one of said first and second projections formed on said insulating case to enable said interconnection.

3. The assembly of claim 2, wherein:

said second projection is provided with a beveled end for easy insertion into said through-hole when said insulating case is pressed to said bobbin to form said interconnection therebetween.

* * * * *